US005468032A

United States Patent [19]

Hebert et al.

[11] Patent Number: 5,468,032

[45] **Date of Patent: *Nov. 21, 1995**

[54] DOOR STOP ASSEMBLY

[76] Inventors: Robert J. Hebert, 936 Ashton Ct., Vista, Calif. 92083; John J. Hebert, 1113 Calle Del Baston, Lake San Marcos, Calif. 92069

[ * ] Notice: The term of this patent shall not extend beyond the expiration date of Pat. No. 5,368,349.

[21] Appl. No.: 344,108

[22] Filed: Nov. 23, 1994

[51] Int. Cl.[6] ..... E05C 17/54; E05F 5/02; E05F 5/06

[52] U.S. Cl. ..... 292/343; 292/DIG. 15; 16/82; 16/85

[58] Field of Search ..... 292/288, 342, 292/343, DIG. 15; 16/82, 85

[56] References Cited

U.S. PATENT DOCUMENTS

| | | | |
|---|---|---|---|
| 1,434,541 | 11/1922 | Hopf | 292/342 |
| 2,205,614 | 6/1940 | Bashe | 292/342 |
| 2,459,070 | 1/1949 | Gard | 292/288 |
| 2,784,443 | 3/1957 | Von Berg | 292/288 |
| 4,208,841 | 6/1980 | Starks | 292/343 |
| 4,230,353 | 10/1980 | Bjorgum | 292/343 |
| 5,368,349 | 11/1994 | Hebert et al. | 292/343 |

FOREIGN PATENT DOCUMENTS 263600 9/1949 Switzerland .

*Primary Examiner*—Steven N. Meyers
*Assistant Examiner*—Tuyet-Phuong Pham
*Attorney, Agent, or Firm*—Charles C. Logan, II

[57] ABSTRACT

A door stop assembly is adapted for introduction between the sliding door and the stationery door of a patio door assembly. The door stop assembly has a wedge block having an integrally formed wedge portion and block portion. A vertical shoulder abutment wall is formed on the block partition where it meets the rear end of the top surface of the wedge portion. A flat strip of spring steel is bent to form a top leg member and a bottom leg member that are oriented to each other at an acute angle and the bottom leg member is secured to the wedge block. The front section is positioned above the top surface of the wedge portion of the wedge block in a spaced relationship thereto. The middle section extends upwardly from the rear end of the front section and is spaced forwardly of the shoulder abutment wall. The rear section has a concave curvature along its longitudinal axis and it extends rearwardly from the top end of the middle section. Any pressure applied to the top surface of the front section of the spring will transfer that pressure to the rear edge of the top leg member and force it downwardly against the top wall of the block portion. There is structure attachable to the bottom surface of the wedge block to prevent it from sliding. The top leg member has a front section, a middle section and a rear section.

6 Claims, 1 Drawing Sheet

DOOR STOP ASSEMBLY

BACKGROUND OF THE INVENTION

The present invention relates generally to a novel door security device. More specifically, it relates to a portable security door stop assembly which can be utilized to resist entry of, for example, intruders and other unauthorized individuals.

The idea of a security device for a door to resist entry by unauthorized individuals is well known. Prior art devices have included a variety of door latching mechanisms permanently attached to, or built in the door. Examples of these devices include traditional dead bolt locks, sliding bolt locks and chain locks. Generally, the devices known in the prior art have several disadvantages. Many of these devices have to be integrally installed as part of the door, as is the case of traditional dead bolt locks. Such installations make the removal and transfer of such devices from one door to another very difficult. Other door latching mechanisms are installed onto the door and/or the surrounding frame by means of fasteners, such as screws or nails, as in the case of sliding bolt locks and chain locks. With these devices the strength of the fastener used often limits the amount of force the door latch mechanism can withstand. These devices also require special tools for installation and removal and are time consuming to move from one door to another. Generally, these devices require that the door be closed or substantially closed for the security device to be operative. Thus, if it is desirable to leave the door partially open, for example to provide ventilation, the security device may be inoperative.

Another concern with traditional door latching mechanisms is that they are often operated by a key or other implement. Thus, authorized individuals must have the appropriate key or implement readily available to unlock, or often lock, such devices. Further, the key or implement may come into the possession of unauthorized individuals, who may utilize the key for unauthorized entry through the door. This risk is particularly great in the case of apartments, and motel or hotel rooms, where numerous individuals have had access and possession of the key or implement to the door latching mechanism.

Other prior art devices have utilized various generally wedged-shaped components to secure a door. Examples of these prior art devices can be seen in U.S. Pat. Nos. 804,585 to Depue, 943,791 to Russell, 1,676,284 to Powell, 1,939,402 to Moser, 2,459,070 to Gard, and 4,230,353 to Bjorgum. Such devices have several disadvantages. Since primary contact between the inclined surface of the wedge and the bottom edge of the door is maintained only along a line of contact, a minimum amount of surface area contact is available to resist the force of, for example, an unauthorized individual attempting to push the door open. Further if the distance between the floor and the bottom of the door exceeds the height of the wedge, such devices will not engage and secure the door. Also, many existing wedges cannot maintain their at rest position without sliding rearwardly due to an excessive amount of force being applied to the door by someone trying to push it open. Also, wedge-shaped devices are normally somewhat bulky and thus would require additional storage space if utilized, by, for example, a traveler in a motel or hotel.

It is an object of the invention to provide a novel door stop assembly that is light weight, compact and can be easily carried in a traveler's suitcase.

It is also an object of the invention to provide a novel door stop assembly that has a unique structure on its bottom surface for preventing it from sliding with respect to a support surface upon which it would be placed.

It is another object of the invention to provide a novel door stop assembly that is economical to manufacture and market.

It is an additional object of the invention to provide a novel door stop assembly that has unique structure such that any pressure applied to the top surface of the spring steel member adjacent the front end off the wedge block will transfer all of that pressure directly to the rear edge of the top leg member of the spring and force the rear edge of the spring downwardly against the top surface of the wedge block.

It is a further object of the invention to provide a novel door stop assembly that has associated structure that can be installed on smooth, slippery surfaces such as the glass panel of a patio door to function in coordination with the door stop assembly.

It is another object of the invention to provide a novel door stop assembly that is primarily designed to be used with a sliding glass patio door.

SUMMARY OF THE INVENTION

The novel doorstop assembly has as its primary components a wedge block, a strip of spring steel and structure that is secured to the bottom surface of the door stop assembly for preventing it from sliding.

The wedge block is preferably in the form of a solid block that may be made of wood or plastic material. It would normally weigh less than 5 or 6 ounces. The size of such a door stop assembly that would normally be carried by a traveler to use in securing their sliding glass patio door from unwanted intruders would be approximately 3½ inches long, and 1½ inches high and 1½ inches wide. The wedge block has a wedge portion and a block portion. The rear end of the wedge portion is contiguous with the front end of the block portion. The top surface of the wedge portion intersects the front wall of the block portion intermediate its height thereby forming a vertical abutment shoulder wall.

The spring would preferably be made of twenty gauge spring steel (although other gauges could be used) that is bent into a wedge-shaped that forms a top leg member and a bottom leg member that are oriented toward each other at an acute angle. The top leg member has a front section, a middle section, and a rear section. The front section of the top leg member is positioned above the top surface of the wedge portion in a spaced relationship thereto. The middle section of the of the top leg member extends upwardly from the rear end of its front section. The middle section is spaced forwardly of the shoulder abutment wall of the block portion. The rear section of the top leg member of the spring extends rearwardly from the top end of the middle section of the spring. The rear section has a concave curvature along its longitudinal axis so that any pressure applied to the top surface of the front section of the spring will transfer that pressure to the rear edge of the rear section of said top leg member and force it downwardly against the top wall of said block portion. The bottom leg member would preferably be secured by adhesive material to the bottom surface of the wedge portion. The bottom surface of the wedge portion may have a recess therein for receiving the bottom leg member.

The structure for preventing the doorstop assembly from sliding has two basic fabric strips. One of these strips has a Velcro hook surface and the second strip has a Velcro loop surface. The top strip has adhesive on its top surface that allows it to be adhered to the bottom surface of the wedge block. The second strip of material has a layer of adhesive on its bottom surface that allows it to be rigidly secured to the glass surface of a sliding glass patio door.

The door stop assembly would be installed with its front end in touching or close approximation to the rear vertical door frame member of a sliding glass patio door. The wedge block would be secured to the stationary patio door. Anyone attempting to force the door to slide open would cause the edge of the door frame to contact the top surface of the spring approximately ¼ to ⅜ of an inch rearwardly of its front end. Any pressure applied to the top surface of the spring adjacent its front end would be transferred directly to the rear edge of the top leg member and function to force the rear of the wedge block downwardly. If continued force is applied to the sliding door in an attempt to open it, the vertical frame member of the sliding door is pushed transversely away from the vertical frame member of the stationary door. This action continues until the vertical frame member of the sliding door contacts the middle section of the spring and forces it against the vertical abutment shoulder wall of the wedge block. This prevents further travel of the sliding glass patio door and prevents entry into the building. The anti-sliding features of the fabric strip functions to lock the door stop assembly in a fixed position that will prevent the door from being slid side ways no matter how great the force being applied to the door by the intruder.

DESCRIPTION OF THE PREFERRED EMBODIMENT

The novel door stop assembly will now be described by referring to FIGS. 1–5 of the drawings. The door stop assembly is generally designated numeral 10.

Figure 1:
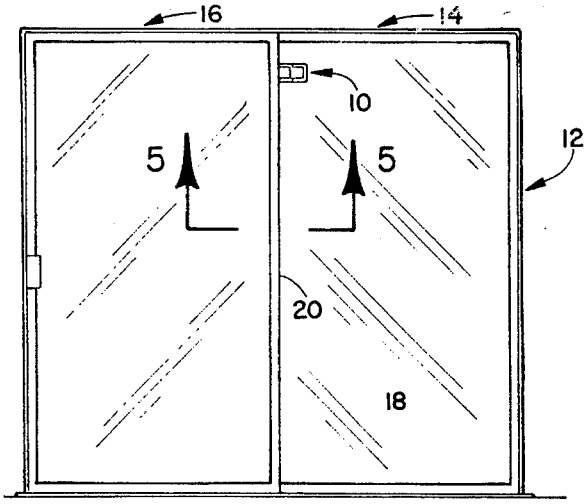
FIG. 1 is a front elevation view showing the novel door stop assembly mounted on the stationary door of a sliding patio door assembly.
Figure 3:
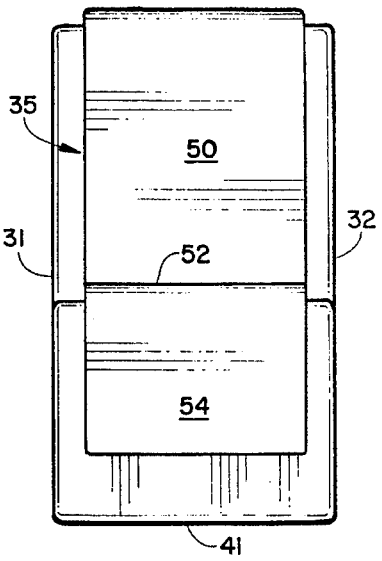
FIG. 3 is a top plan view of the novel door stop assembly.

FIG. 1 discloses the manner in which door stop assembly 10 is used. A sliding glass patio door assembly 12 has a stationary patio door 14 and a sliding patio door 16. The door stop assembly may be positioned anywhere along the height of glass pane 18 of stationary patio door 14. The front end of the door stop assembly is positioned adjacent the edge of the vertical door frame member 20 of sliding patio glass door 16.

Figure 2:
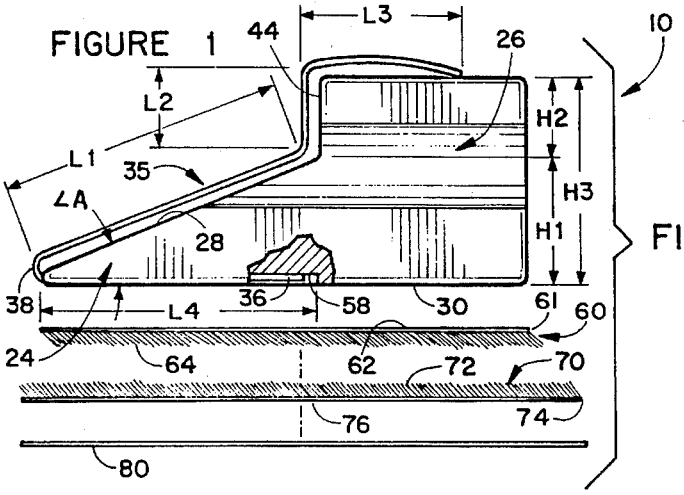
FIG. 2 is an exploded side elevation view of the novel door stop assembly.
Figure 4:
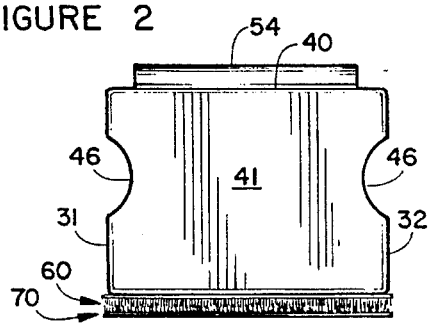
FIG. 4 is a rear elevation view of the novel door stop assembly.
Figure 5:
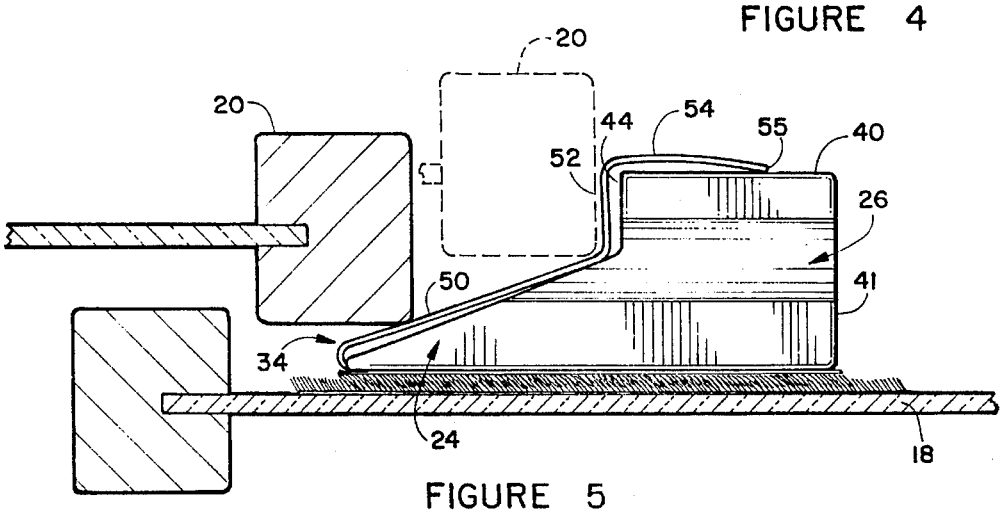
FIG. 5 is a cross sectional view taken along lines 5—5 of FIG. 1.

The specific structure of door stop assembly 10 is best understood by referring to FIG. 2. It has a wedge portion 24 and a block portion 26. The rear end of wedge portion 24 is contiguous with the front surface of block portion 26. Wedge portion 24 has a top surface 28 and a bottom surface 30. The front end of these two surfaces intersect each other at an acute angle A. Wedge portion 24 has laterally spaced side walls 31 and 32. It has a height H1 at its rear end.

Flat strip spring 34 has a top leg 35 and a bottom leg 36. The front ends of the respective top and bottom legs intersect each other at an acute angle and are interconnected together by a bend portion 38.

Block portion 26 has a top wall 40, a rear wall 41, a bottom wall 30, laterally spaced side walls 31 and 32, and a vertical abutment shoulder wall 44. Vertical abutment shoulder wall 44 has a height H2 and rear 41 has a height H3. Finger gripping grooves 46 are formed in the respective side walls.

Top leg member 35 has a front section 50, a middle section 52 and a rear section 54. Front section 50 has a length L1 and it is spaced a predetermined distance above the top surface of wedge portion 24. Middle section 52 has a length L2 and it is spaced forwardly of vertical abutment shoulder 44. Rear section 54 has a length L3 and it has a concave configuration along its longitudinal axis. Its rear edge 55 is directed against top wall 40. Bottom leg 36 has a length L4 and it is positioned in a recess 58 in bottom wall 30. It is secured thereto by an adhesive or other mechanical structure.

Fabric strip 60 has a substrate 61 having an adhesive 62 on its top surface. Velcro hook material 64 is on the bottom surface of substrate 61. Fabric strip 60 is secured to the bottom surface 30 of wedge block by adhesive 62.

Fabric strip 70 has Velcro hook material 72 attached to its top surface. It has a substrate layer 74 having a layer of adhesive 76 on its bottom surface. A peel away cardboard sheet 80 is detachably secured to adhesive layer 76 when it is not in use.

What is claimed is:

1. A door stop assembly adapted for introduction between the sliding door and the stationary door of a sliding patio door assembly comprising:

a wedge block having a wedge portion and a block portion;

said wedge portion having a top surface having a front edge and a rear edge; said wedge portion also having a bottom surface having a front edge, a rear end and a pair of laterally spaced side walls; (the) said front (ends) edges of said top surface and said bottom surface are oriented toward each other at an acute angle; said wedge portion has a height H1 at its rear end;

said block portion having a front end, a rear wall, a top wall, a bottom wall, and laterally spaced side walls; (the) said front end of said block portion being contiguous with (the) said rear end of said wedge portion; said block portion having a front wall that extends upwardly from (the) said rear edge of (the) said top surface of said wedge portion to form a shoulder abutment wall having a height H2;

a spring having a top leg member with a front end and a rear edge, said spring having a bottom leg member with a front end and (the) said front ends of said leg members are oriented toward each other at an acute angle;

(the) said top leg member of said spring has a front section, a middle section, and a rear section; said front section having a top surface and a rear end; said middle section having a top end and a bottom end; said rear section having a rear edge;

the bottom leg member of said spring being secured to (the) said bottom surface of said wedge portion and (the) said front section of said top leg member being positioned above (the) said top surface of (the) said wedge portion of said wedge block in a spaced relationship thereto;

the middle section of (the) said top leg member of said spring extends upwardly from (the) said rear end of its front section; said middle section being spaced forwardly of (the) said shoulder abutment wall of said block portion and it has a top end;

the rear section of (the) said top leg member of said spring extends rearwardly from (the) said top end of (the) said middle section of said spring; said rear section having a concave curvature along its longitudinal axis so that any pressure applied to (the) said top surface of (the) said front section of said spring will transfer that pressure to (the) said rear edge of (the) said rear section of said leg member and force it downwardly against the (the) said top wall of said block portion;

means (of the) on said bottom surface of said wedge block for preventing it from sliding with respect to a support surface upon which it would be placed.

2. A door stop assembly as recited in claim 1 wherein said wedge block is made of plastic material.

3. A door stop assembly as recited in claim 1 wherein said wedge block is made of wood.

4. A door stop assembly as recited in claim 1 wherein said spring is made of a flat strip of spring steel.

5. A door stop assembly as recited in claim 1 wherein the bottom surface of said wedge block has a longitudinally extending recess that receives said bottom leg member of said spring.

6. A door stop assembly as recited in claim 1 wherein said wedge block has finger gripping grooves in the respective laterally spaced side wall surfaces.

* * * * *